United States Patent [19]

Lionetti et al.

[11] 4,388,175

[45] Jun. 14, 1983

[54] HYDROCARBON CONVERSION PROCESS

[75] Inventors: Thomas A. Lionetti, Houston; Charles H. Schrader, Groves, both of Tex.

[73] Assignee: Texaco Inc., White Plains, N.Y.

[21] Appl. No.: 330,625

[22] Filed: Dec. 14, 1981

[51] Int. Cl.[3] ..... C10G 11/05; C10G 55/08

[52] U.S. Cl. ..... 208/74; 208/50; 208/77

[58] Field of Search ..... 208/74, 50, 67, 77

[56] References Cited

U.S. PATENT DOCUMENTS

| | | | |
|---|---|---|---|
| 2,775,549 | 12/1956 | Shea | 208/50 X |
| 2,871,182 | 1/1959 | Weekman | 208/50 |
| 2,963,416 | 12/1960 | Ward et al. | 208/50 |
| 3,775,294 | 11/1973 | Peterson et al. | 208/88 |
| 3,891,538 | 6/1975 | Walkey | 208/50 |
| 4,312,742 | 1/1982 | Hayashi | 208/50 |

*Primary Examiner*—Delbert E. Gantz
*Assistant Examiner*—G. E. Schmitkons
*Attorney, Agent, or Firm*—Carl G. Ries; Robert A. Kulason; Robert Knox

[57] ABSTRACT

A process for the production of highly aromatic petroleum fractions from various petroleum feedstocks suitable for catalytic cracking in a fluidized catalytic cracking unit wherein heavy gas oil from a first fluidized catalytic cracking unit is subjected to further catalytic cracking in a separate fluid catalytic cracking unit at temperatures in the range of 565° to 650° C. producing light olefins and a heavy gas oil consisting of essentially aromatic components suitable for the production of needle coke, and the method of producing needle coke from various hydrocarbon cracking stocks.

5 Claims, 1 Drawing Figure

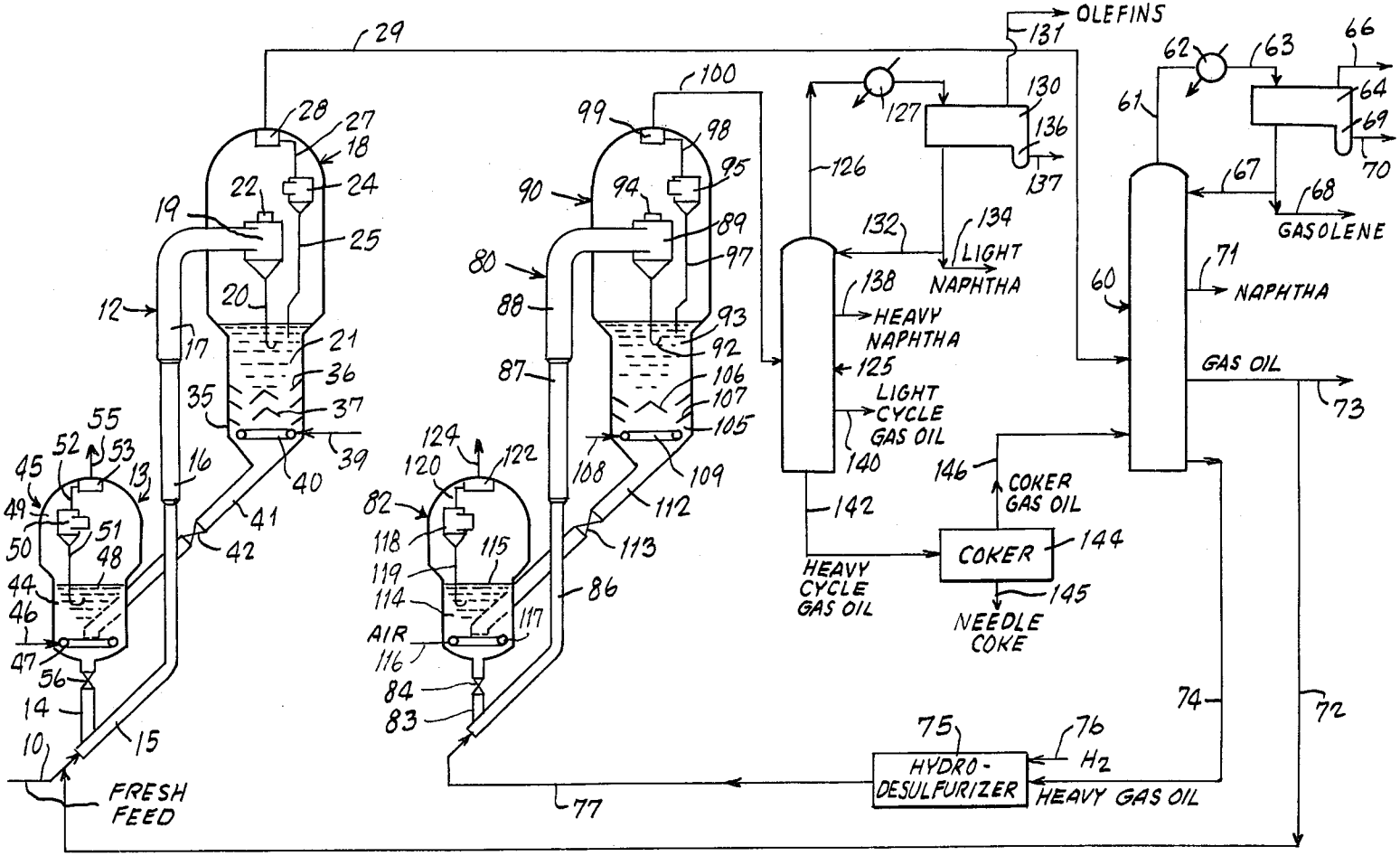
GASOLENE
NAPHTHA
GAS OIL
OLEFINS
LIGHT NAPHTHA
HEAVY NAPHTHA
LIGHT CYCLE GAS OIL
HEAVY CYCLE GAS OIL
COKER GAS OIL
COKER
NEEDLE COKE
HYDRO-DESULFURIZER
HEAVY GAS OIL
H2
AIR
FRESH FEED

HYDROCARBON CONVERSION PROCESS

This invention relates to a process for catalytic conversion of hydrocarbon feedstocks to products including light olefins and aromatic fractions. In one of its more specific aspects, this invention relates to a process for preparing a petroleum coker feedstock for the production of needle coke suitable for the manufacture of electrodes from sulfur-containing fluid catalytic cracking feedstocks.

Various grades of coke may be produced from petroleum charge stocks by thermal cracking. A thermal cracking process known as Delayed Coking is commonly employed for the production of electrode grade coke from the residual or bottoms fractions from atmospheric or vacuum distillation of low sulfur crude oils. In the Delayed Coking process, a heavy charge stock is heated to about 500° C. in a furnace and then passed into a large insulated vessel where cracking and coke formation take place with the production of coke and both gaseous and liquid products lower boiling than the feedstock. The normally gaseous and normally liquid products are discharged as vapors from the coking drum. The residual coke accumulates in the coke drum until it is filled, at which time the charge is switched to an empty drum and the coke removed, after steaming, from the coke-filled drum.

It is known to those skilled in the art that the preferred feedstocks for the manufacture of needle coke are highly aromatic fractions which are normally obtained as heavy gas oil fractions from fluid catalytic cracking processes operating on low-sulfur charge stock or from thermal tars obtained as by-products in the conventional thermal cracking of naphtha or gas oil hydrocarbons fractions for the production of ethylene. Illustrative process are disclosed in U.S. Pat. Nos. 4,177,133 and 3,891,538. Various methods for producing needle coke feedstock are disclosed in U.S. Pat. No. 2,775,549.

The process of the present invention provides a method for the production of needle coke feedstocks from sulfur-containing heavy gas oils. In accordance with the present invention, a sulfur-containing heavy gas oil fraction from fluid catalytic cracking unit (FCCU) is hydrodesulfurized and charged to a high temperature riser type fluidized catalytic cracking unit which converts a portion of the heavy gas oil feedstock to aromatic gas oil products comprising over 75 weight percent aromatics, typically 85 to 100 percent aromatic components. High octane motor fuel components and light olefins are also produced in addition to the aromatic gas oils. The heavy gas oil fraction from this second FCCU cracking operation is a suitable charge stock for the production of needle coke. Thus, the process of this invention provides a means for converting relatively low value, high-sulfur, heavy gas oil fractions from fluid catalytic cracking processes to valuable products including light olefins, high octane gasoline blending components, and needle coke.

The process of this invention is illustrated in more detail in the accompanying drawing which is a diagrammatic representation of the process flow and of apparatus suitable for use for carrying out the process of this invention.

With reference to the drawing, a specific example of a preferred embodiment of the process of this invention is illustrated. In this example, a hydrocarbon charge stock, for example, a virgin naphtha or gas oil, is supplied to a fluid catalytic cracking unit (FCCU) through line 10 into the first section of a tapered riser reactor 12 into contact with hot regenerated equilibrium molecular sieve zeolite cracking catalyst withdrawn from catalyst regenerator 13, described in more detail hereinafter, through standpipe 14.

The resulting suspension of catalyst in oil vapor passes upwardly through successive sections 15, 16 and 17 of the fresh feed riser reactor into separator vessel 18. The fresh feed riser reactor 12, comprising sections 15, 16 and 17, terminates in a cyclone separator 19 in which a rough separation of catalyst and oil vapors occurs. The separated catalyst flows downwardly through dipleg 20 into a dense phase fluidized bed of catalyst 21 in the lower part of separator vessel 18.

As a specific example of suitable reaction conditions in the riser reactor 12, the catalyst-to-oil weight ratio is preferably in the range of from about 5 to about 10, the reactor riser outlet temperature is within the range of 510° to 540° C., and the reactor pressure is within the range of about 1.35 to 4.5 bar. The average residence time in riser reactor 12 is preferably in the range of about 2 to about 5 seconds with an overall conversion in the range of 60 to 80 volume percent. Substantial conversion of fresh feed occurs in the riser 12 to products boiling below 220° C. The regenerator temperature (recycle catalyst temperature) is preferably in the range of 595° to 730° C.

If desired, a heavy naphtha or a cycle gas oil from line 72 may be introduced with fresh feed from line 10 into the inlet section 15 of reactor riser 12 wherein it is contacted under reaction conditions described hereinafter with hot zeolite catalyst as described above supplied from catalyst regenerator 13 through standpipe 14.

Products of the cracking reaction pass upwardly through the outlet section 22 of cyclone separator 19, into cycle separator 24 wherein entrained catalyst is separated from the vapors and gases comprising unconverted hydrocarbons, and reaction products. The separated catalyst is returned to the fluidized bed of catalyst in the reactor through dipleg 25. Although a single cyclone separator is illustrated, it is customary to provide an assembly of several cyclone separators in series to achieve substantially complete separation of catalyst from vapors and gases leaving the reactor. As is well known in the art, a plurality of such assemblies may be employed in large reactors.

Effluent vapors and gases pass from cyclone separator 24 through line 27 to plenum chamber 28 wherein the vapors and gases from other cyclone separator assemblies, not illustrated, are collected and discharged from the reactor through line 29. Vapor line 29 conveys cracked products to fractionation facilities, described hereinafter, wherein the converted products are recovered and separated into desired product and recycle streams.

Catalyst from the dense phase bed 21 in the lower portion of reactor vessel 18 moves downwardly into a stripping zone 35 in the lower part of the separator vessel 18. Stripping zone 35 is provided with baffles 36 and 37 of known type. Stripping steam is introduced into stripping zone 35 through line 39 and steam distributor ring 40, situated below baffles 36 and 37. Steam rising through the catalyst in stripping zone 35 displaces and removes sorbed and entrained hydrocarbon vapors from the catalyst. Stripping steam and stripped hydrocarbons are discharged from the stripper into the upper portion of separator vessel 18.

Stripped catalyst is withdrawn from the bottom of stripper 35 through spent catalyst standpipe 41 at a rate controlled by slide valve 42 and discharged into a dense fluidized bed of catalyst 44 in regenerator 13. In regenerator 13, the spent catalyst is contacted with air introduced through line 46 and air distributor ring 47 into the lower portion of the dense phase fluidized bed of catalyst in regenerator 13. The dense phase fluidized bed of catalyst undergoing regeneration in regenerator 13 has a fairly well defined upper surface 48. Sufficient air is introduced into the regenerator through line 46 for complete combustion of all of the carbonaceous material from the catalyst undergoing regeneration. The resulting flue gases pass upwardly from the dense phase bed of catalyst 44 into the dilute phase section 49 of the catalyst regenerator above bed surface 48 and enter cyclone separator 50 wherein entrained catalyst is separated from the flue gases and returned to the dense phase fluidized bed of catalyst 48 through dipleg 51.

Cyclone separator 50, although represented diagrammatically as a single unit, may comprise one or more assemblies of cyclone separators arranged in parallel and in series as in reactor vessel 18, to effect substantially complete separation of entrained solids from the flue gases.

Effluent flue gas from cyclone separator 50 is passed through line 52 into the plenum chamber 53 and through flue line 55 to vent facilities, not shown, which may include means for recovery of heat from the hot flue gas. The flue gas discharged from regenerator 45 through line 55 consists essentially of nitrogen, carbon dioxide, water vapor, and 1 to 10 volume percent oxygen. Preferably, the regenerator flue gas, dry basis, comprises about 2 to 5 volume percent oxygen and typically contains about 81 to 88 percent nitrogen, and 10 to 16 percent carbon dioxide, together with trace amounts of carbon monoxide, sulfur oxides and nitrogen oxides. Various means for recovering heat energy from hot flue gases discharged through line 55 prior to their release to the atmosphere, e.g. by generation of steam in a boiler or expansion through gas turbines with the generation of power, are well known in the art.

Regenerated catalyst is withdrawn from the bottom of regenerator 13 through line 14 at a rate controlled by slide valve 56 to supply hot regenerated catalyst to riser reactor 12, as described hereinabove.

Product vapor discharged from the reactor vessel 18 through line 29 passes to a fractional distillation column 60 wherein products of reaction are separated into desired component fractions according to their boiling ranges. A vapor fraction comprising gasoline and lighter hydrocarbons passes overhead from the fractional distillation column 60 through line 61 into condenser 62 wherein substantially all of the gasoline boiling range fraction is condensed. From the condenser 62, condensate and uncondensed vapors flow through line 63 into an accumulator vessel 64, wherein gases and uncondensed vapors are separated from condensate. The gases and uncondensed vapors, comprising hydrocarbons lighter than gasoline, are discharged from the accumulator 64 through line 66. A portion of the condensate comprising gasoline is passed from accumulator 64 via line 67 to the fractional distillation column 60 as reflux. Product gasoline is withdrawn from the accumulator vessel 64 through line 68 for further treatment, not illustrated. Water, which comprises condensed stripping steam from the reactor vessel 18, collects in the accumulator leg 69 from which it is removed via line 70.

A heavy naphtha fraction is withdrawn from the fractional distillation column 60 through line 71 to storage, not illustrated. A stream comprising a light gas oil is withdrawn from fractional distillation column 60 and passed via line 72 and line 19 to the inlet section of riser 12 as hereinabove described. The temperature at which the cycle gas oil stream is transferred to the reactor is about the boiling point temperature of the gas oil fraction. If desired, a gas oil product may be recovered from line 72 via line 73 through which the gas oil passes through storage, not illustrated. A heavy residuum or heavy cycle gas oil fraction is withdrawn from the bottom of fractional distillation column 60 through line 74.

In accordance with this invention, heavy residuum or heavy cycle gas oil obtained as a bottoms fraction from fractional distillation column 60 is passed through line 74 to hydrodesulfurization reactor 75. Hydrogen is introduced into hydrodesulfurization zone 75 through line 76. Desulfurization is carried out by charging the heavy cycle gas oil over a conventional cobalt-molybdenum or nickel-molybdenum catalyst at 385° to 403° C. at 104 to 140 bar (1500 to 2000 psig) at a liquid hourly space velocity (LHSV) of 0.25 to 1, suitably about 0.5. The desulfurization step requires about 0.356 cubic meters per liter (2000 scf/bbl) of hydrogen.

The desulfurized heavy gas oil from the hydrodesulfurization zone 75 is passed through line 77 to riser reactor 80 of a separate FCCU. The desulfurized heavy gas oil charge stock from line 77 contacts hot equilibrium molecular sieve zeolite cracking catalyst in riser reactor 80, preferably comprising a tapered riser, similar to riser reactor 12. Hot regenerated catalyst is supplied to riser reactor 80 from catalyst regenerator 82 through standpipe 83 at a rate controlled by slide valve 84. The regenerated catalyst, which preferably has a carbon content less than 0.1 weight percent, is withdrawn from the regenerator 82 at a temperature in the range of from about 650° C. to about 790° C. and introduced into the lowermost section 86 of riser reactor 80. The resulting mixture of hydrocarbon vapors and catalyst suspended therein passes upwardly through section 86 of riser reactor 80, suitably at an average superficial gas velocity within the range from about 20 to about 50 feet per second. As a specific example of preferred reaction conditions in the riser reactor 80, the catalyst-to-oil weight ratio is preferably in the range of 5 to 10; the reactor riser outlet temperature, in the range of 565° to 620° C.; and reactor pressure, in the range of 1.35 to 4.5 bar (5 to 51 psig). The average residence time in riser reactor 80 is preferably in the range of 1 to 5 seconds to give an overall conversion in the range of 70 to 80 volume percent of the feed. The catalyst regeneration temperature (recycle catalyst temperature) is preferably in the range of 650° to 790° C.

Cracking, dehydrogenation and reforming of the hydrocarbon feedstock and reaction products take place in the riser reactor. The mixture of reaction products and catalyst passes upwardly through successive sections 86, 87, and 88 or riser reactor 80. Each of sections 86, 87, and 88 has a larger cross-sectional area than the preceding section, the cross-sectional areas increasing in the direction of flow of reactants and catalyst. The resulting mixture of hydrocarbon vapors, gases and catalyst discharge into separator 89 contained in vessel 90 wherein catalyst is separated from the hydrocarbon gases and vapors.

Separator 89 preferably comprises a cyclone type separator in which a rough separation, e.g. 85 to 90 percent separation, of catalyst from hydrocarbon gases and vapors takes place. The separated catalyst flows downwardly through dipleg 92 into a dense phase fluidized bed of catalyst 93 in the lower part of the reactor-separator section of vessel 90. Dipleg 92 may be provided at its lower end with a suitable gas seal, such as the known J-seal, illustrated. The hydrocarbon vapors, still containing some entrained catalyst, are discharged from separator 89 through outlet 94, into the dilute phase upper section of reactor-separator vessel 90 wherein a further separation of entrained catalyst from hydrocarbon vapors takes place.

Products of the cracking reaction pass upwardly through the dilute phase section of vessel 90, into cyclone separator 95 wherein entrained catalyst is separated from the vapors. The separated catalyst is returned to the fluidized bed of catalyst 93 in the reactor-separator section of vessel 90 through dipleg 97. Although a single cyclone separator 95 is illustrated, it is customary to provide several cyclone separators in series to achieve substantially complete separation of catalyst from vapors and gases leaving the reactor. As is well known in the art, a plurality of such assemblies may be employed. Effluent vapors and gases pass from cyclone separator 95 through line 98 to plenum chamber 99 wherein the vapors and gases from other cyclone separator assemblies, not illustrated, are collected and discharged from the reactor through line 100.

Catalyst from the dense phase fluidized bed of catalyst 93 in the lower portion of reactor-separator vessel 90 passes downwardly into a catalyst stripping zone 105 where the catalyst is stripped with steam. Stripping zone 105 is provided with baffles 106 and 107 of known type. Stripping steam is introduced into stripping zone 105 through line 108 and steam distributor ring 109, situated below baffles 106 and 107. Steam rising through the catalyst in stripping zone 105 displaces and removes absorbed and entrained hydrocarbons from the catalyst. Stripping steam and stripped hydrocarbons are discharged from the stripping zone 105 into the upper portion of reactor-separator vessel 90.

Stripped catalyst is withdrawn from the bottom of stripper 105 through spent catalyst standpipe 112 at a rate controlled by slide valve 113 into a dense phase fluidized bed of catalyst 114 in regenerator 82. In regenerator 82, stripped spent catalyst is contacted with air introduced through line 116 and air distributor ring 117 into the lower portion of the dense phase bed of catalyst. The dense phase fluidized bed of catalyst undergoing regeneration in regenerator 82 has an upper surface 115, where flue gases resulting from regeneration of the catalyst with air are disengaged from the dense phase fluidized bed 114. Above the upper surface of bed 114, further separation of catalyst from flue gases take place in the dilute phase section of catalyst regenerator 82. Sufficient air is introduced into the regenerator through line 116 for complete combustion of all of the carbonaceous material from the catalyst undergoing regeneration. The resulting flue gases pass upwardly from the dense phase bed of catalyst into the dilute phase section of the catalyst regenerator 82 and enter cyclone separator 118 wherein entrained catalyst is separated from the flue gases and returned to the dense phase fluidized bed of catalyst 114 through dip leg 119.

Cyclone separator 118, although represented diagrammatically as a single unit, may comprise an assembly of cyclone separators arranged in parallel and in series, as in reactor-separator vessel 90, to effect substantially complete separation of entrained solids from the flue gas.

Effluent flue gas from cyclone separator 118 is passed through line 120 into the plenum chamber 122 and through flue line 124 to vent facilities, not illustrated.

Hot regenerated catalyst is withdrawn from the bottom of regenerator 82 to standpipe 83 at rates controlled by slide valve 84 to supply hot regenerated catalyst to riser reactor 80, as described hereinabove.

In regenerator 82, the spent catalyst is contacted with sufficient air introduced into the regenerator through line 116 for complete combustion of all of the carbonaceous material from the catalyst undergoing regeneration. Coke burned from the spent stripped catalyst in regenerator 82 heats the catalyst to a temperature in the range of 650° C. to 790° C. Hot regenerated catalyst supplies heat for hydrocarbon conversion in riser reactor 80.

Oxygen-containing regeneration gas is provided in an amount sufficient to effect substantially complete combustion of all of the coke on the catalyst to carbon dioxide and water vapor and in addition to provide an oxygen concentration in the flue gas in the range of from about 1 to about 10 mole percent and preferably from about 3 to about 5 mole percent, dry basis. Typically coke contains from eight to eleven percent hydrogen by weight. Water vapor is produced during the regeneration of the catalyst by the consumption of hydrogen contained in the coke. Flue gas compositions throughout this specification are on a dry, i.e. moisture free, basis.

The oxygen-containing regeneration gas that may be employed in practicing the process of this invention include air and gases which contain molecular oxygen in admixture with inert gases. Air is a particularly suitable regeneration gas and is generally preferred. Additional gases which may be employed include oxygen in combination with carbon dioxide or flue gas or other inert gases. If desired, steam may be included in the regeneration mixture.

Product vapors discharged from the reactor through line 100 pass from the reactor vessel 90 to a fractional distillation column 125 wherein products of reaction are separated into desired component fractions according to their boiling ranges. A vapor fraction comprising gasoline and lighter hydrocarbons passes overhead from the fractional distillation column 125 through line 126 to condenser 127 wherein steam and a gasoline boiling range fraction are condensed. From the condenser 127, condensate and uncondensed vapors flow into an accumulator vessel 130 wherein uncondensed vapors are separated from condensate. The uncondensed vapors, comprising gases and light hydrocarbons including two to five carbon atom olefins, are recovered from the accumulator 130 through line 131. A portion of the condensate is passed from accumulator 130 via line 132 to the fractional distillation column 125 as reflux. A high octane number aromatic gasoline blending stock is withdrawn from the accumulator vessel 130 through line 134 for further treatment, not illustrated. Water, which comprises condensed stripping steam from the reactor vessel 90, collects in an accumulator leg 136 from which it is removed via line 137.

A heavy naphtha fraction is withdrawn from the fractional distillation column 125 through line 138 to storage, not illustrated. A light cycle gas oil is withdrawn from fractional distillation column 125 and passed via line 140 to storage. A heavy residuum or heavy cycle gas oil fraction is withdrawn from the bottom of fractional distillation column 125 through line 142 to coker 144 where it is subjected to delayed coking for the production of needle coke. Needle coke is recovered from the coking drums, not illustrated, through line 145. Coker gas oil vapors may be passed throgh line 146 to fractional distillation tower 60 for recycle to high temperature fluid catalytic reactor 80.

Some of the advantages of the process of this invention will be apparent to those skilled in the art from the detailed data of test results reported in the following examples.

EXAMPLE 1

A vacuum gas oil from a Beri crude is employed as charge stock to a first pure riser reactor fluid catalytic cracking unit (FCCU I). The characteristics of the charge stock are shown in Table I.

TABLE I

| Vacuum Gas Oil - Beri Crude | |
|---|---|
| Gravity, API | 22.0-25.0 |
| Characterization Factor, $K_B$ | 11.93-12.10 |
| Basic Nitrogen, wppm | 100-300 |
| Total Nitrogen, wppm | 330-800 |
| Sulfur, wt % | 1.4-2.0 |
| Aromatics, wt % | 44-48.5 |
| U.V. Absorbance at 285 mμ | 8.0-13.7 |
| C5 Insolubles, wt % | 0.01-0.07 |
| Conradson Carbon Residue, wt % | 0.27-0.54 |
| TBP Distillation, °C. | |
| IBP | 304 |
| EP | 566 |

The first fluid catalytic cracking unit (FCCU I) is operated under the following conditions:

| Operating Conditions FCCU I | |
|---|---|
| Riser Outlet Temperature | 529° C. |
| Pressure, bar | 2.8 |
| TPR (1) | 1.0 |
| Catalyst Activity, D + L | 66 |
| Conversion, vol % | 72.27 |
| WHSV (2) | Pure Riser Cracking |

(1) Throughput ratio (1+ recycle/fresh feed)
(2) Weight hourly space velocity

Product yield and quality are shown in Table II.

TABLE II

| FCCU I Product Yields, Weight % of Feed | |
|---|---|
| $H_2S$ ($NH_3$) | 0.58 |
| Hydrogen | 0.07 |
| Methane | 1.09 |
| Ethane | 1.12 |
| Ethylene | 1.02 |
| Propane | 1.47 |
| Propylene | 4.94 |
| Isobutane | 2.54 |
| Normal Butane | 1.27 |
| Butylene | 5.80 |
| DB Naphtha (1) | 44.74 |
| LCGO (2) | 10.48 |
| HCGO (3) | 6.49 |
| Coke | 5.40 |
| DB Naphtha Quality | |
| Gravity, API | 61.8 |
| Sulfur, wt % | 0.05 |

TABLE II-continued

| FCCU I Product Yields, Weight % of Feed | |
|---|---|
| Research Octane No. | 89.8 |
| Motor Octane No. | 79.8 |
| LCGO Quality | |
| Gravity, API | 21.5 |
| Sulfur, wt % | 2.48 |
| Pour, C. | −60 |
| HCGO Quality | |
| Gravity, API | −0.5 |
| Sulfur, wt % | 4.50 |
| Aromatics, wt % | 77.7 |
| Conradson Carbon Residue, wt % | 8.90 |
| $nC_5$ Insolubles, wt % | — |
| U.V. Absorbance at 285 mμ | 46.08 |

(1) Debutanized Naphtha
(2) Light cycle gas oil
(3) Heavy cycle gas oil

The heavy cycle gas oil (HCGO) from FCCU I has the following properties.

TABLE III

| Heavy Cycle Gas Oil from FCCU I | |
|---|---|
| Gravity, API | −0.40 |
| Characterization Factor, $K_B$ | 10.24 |
| Basic Nitrogen, wppm | — |
| Total Nitrogen, wppm | 1500 |
| Sulfur, wt % | 4.10 |
| Aromatics, wt % | 100 |
| U.V. Absorbance at 285 mμ | 53.4 |
| C5 Insolubles, wt % | 3.47 |
| Conradson Carbon Residue wt % | 9.70 |
| TBP Distillation, C. | |
| IBP −10 | −418 |
| 20-30 | 442-457 |
| 40-50 | 471-483 |
| 60-70 | 496-509 |
| 80-90 | 527- |
| EP | — |

The HCGO material from FCCU I is desulfurized at the following conditions:

| Operating Conditions - Desulfurizer | |
|---|---|
| Average Catalyst Temperature, C. | 392 |
| Reactor Pressure, bar | 142.2 |
| LHSV (1) | 0.48 |
| $H_2$ Consumption, $m^3/l$ | 0.415 |

(1) Liquid Hourly Space Velocity

The product yields and total product liquid quality are shown in Table IV.

TABLE IV

| Hydrotreater Product Yields, % Basis Feed | |
|---|---|
| $H_2S$ ($NH_3$) | 4.15 (0.17) |
| Hydrogen | −3.30 |
| Methane | 0.52 |
| Ethane | 0.40 |
| Ethylene | — |
| Propane | 0.29 |
| Propylene | — |
| Isobutane | 0.01 |
| Normal Butane | 0.22 |
| Butylene | — |
| DB Naphtha | 1.47 |
| LCGO | 18.04 |
| HCGO | 78.04 |
| Coke | |
| Sulfur, wt % | 0.24 |
| Aromatics, wt % | 70.9 |
| Conradson Carbon Residue, wt % | 1.85 |
| $nC_5$ Insolubles, wt % | 0.24 |
| U.V. Absorbance at 285 mμ | 16.00 |

TABLE IV-continued

| Hydrotreater Product Yields, % Basis Feed | |
|---|---|
| Gravity, API | 15.2 |

Heavy cycle gas oil from the hydrogenation unit has the characteristics shown in Table V.

TABLE V

| Hydrotreated Heavy Cycle Gas Oil | |
|---|---|
| Gravity, API | 14.4 |
| Characterization Factor, $K_B$ | 10.51 |
| Basic Nitrogen, wppm | 25 |
| Total Nitrogen, wppm | 180 |
| Sulfur, wt % | 0.24 |
| Aromatics, wt % | 70.1 |
| U.V. Absorbance at 285 mμ | 16.0 |
| C5 Insolubles, wt % | 0.44 |
| Conradson Carbon Residue, wt % | 2.16 |
| TBP Distillation, C. | |
| IBP −10 | −298 |
| 20-30 | 348-376 |
| 40-50 | 402-428 |
| 60-70 | 451-472 |
| 80-90 | 493-523 |
| EP | — |

The desulfurized heavy cycle gas oil of Table V from the hydrogenation unit is charged to a second pure riser type fluid catalytic cracking unit (FCCU II) operated under the following conditions:

| Operating Conditions FCCU II | |
|---|---|
| Riser Outlet Temperature, °C. | 593 |
| Pressure | Atmospheric |
| TPR (1) | 1.0 |
| Conversion, vol % | 64.25 |

(1) Throughput ratio (1+ recycle/fresh feed)

Product yields and quality from FCCU II are shown in Table VI.

TABLE VI

| FCCU II Product Yields, % Basis Feed | |
|---|---|
| $H_2S$ ($NH_3$) | 0.07 |
| Hydrogen | 0.91 |
| Methane | 4.95 |
| Ethane | 2.45 |
| Ethylene | 2.22 |
| Propane | 2.38 |
| Propylene | 5.67 |
| Isobutane | 3.64 |
| Normal Butane | — |
| Butylene | 4.73 |
| DB Naphtha | 23.30 |
| LCGO | 22.15 |
| HCGO | 17.47 |
| Coke | 10.06 |
| DB Naphtha Quality | |
| Gravity, API | 41.9 |
| Sulfur, wt % | 0.005 |
| Research Octane No. | 100.2 |
| LCGO Quality | |
| Gravity, API | 8.7 |
| Sulfur, wt % | 0.27 |
| Pour, C. | −46 |
| HCGO Quality | |
| Gravity, API | −9.4 |
| Sulfur, wt % | 0.51 |
| Aromatics, wt % | 100.0 |
| Conradson Carbon Residue, wt % | — |
| $nC_5$ Insolubles, wt % | — |
| U.V. Absorbance at 285 mμ | 73.58 |

The overall yield distribution of products from both fluid catalytic cracking units on the basis of the vacuum oil charge stock is shown in Table VII.

TABLE VII

| Overall Product Yields, % Basis Feed | |
|---|---|
| $H_2S$ ($NH_3$) | 0.92 (0.01) |
| Hydrogen | −0.09 |
| Methane | 1.54 |
| Ethane | 1.39 |
| Ethylene | 1.24 |
| Propane | 1.75 |
| Propylene | 5.68 |
| Isobutane | 2.96 |
| Normal Butane | 1.37 |
| Butylene | 6.53 |
| DB Naphtha | 49.41 |
| LCGO | 12.70 |
| HCGO | 8.13 (1) |
| Coke | 6.47 |
| DB Naphtha Quality | |
| Gravity, API | ~61.2 |
| Sulfur, wt % | ~0.05 |
| Research Octane No. | ~90.1 |
| LCGO Quality | |
| Gravity, API | ~21.0 |
| Sulfur, wt % | ~2.4 |
| Pour, F. | — |

(1) Feed to coker to produce needle coke

It is evident from this example that the heavy cycle gas oil from the second fluid catalytic cracking unit (FCCU II) is highly aromatic and very low in contaminants, such as sulfur and metals, and is a superior feed for needle coke production.

EXAMPLES 2-5

Conversions, yields and product quality data were obtained from 23 high reactor temperature catalytic cracking runs on a West Texas-New Mexico gas oil on a five barrel per day fluid catalytic cracking pilot unit. Characteristics of the charge stock are shown in Table VII.

TABLE VIII

| West Texas-New Mexico Gas Oil | |
|---|---|
| Gravity, API | 25.9 |
| Characterization Factor, $K_b$ | 11.73 |
| Conradson Carbon Residue, wt % | 0.05 |
| Pentane Insolubles, wt % | 0.007 |
| Pour Point, C. | +27 |
| Viscosity, cst at | |
| 38 C. | 19.30 |
| 50 C. | 12.28 |
| 77 C. | 6.55 |
| RI at 25 C. | 1.5230 |
| Aniline Point, C. | 73.0 |
| Bromine Number | 12.9 |
| Watson Aromatics, wt % | 48.6 |
| Total Nitrogen, wppm | 604 |
| Basic Nitrogen, wppm | 289 |
| Sulfur, wt % | 1.90 |

The product from the reactor was fractionated in a high efficiency packed batch distillation column into the following fractions:

| | |
|---|---|
| IBP −46° C. | Pentanes and Lighter |
| 46-121° C. | Light Naphtha |
| 121 to 221° C. | Heavy Naphtha |
| 221 to 354° C. | Light Cycle Gas Oil |
| 354° C.+ | Heavy Cycle Gas Oil |

An equilibrium Davison CBZ-1 ® catalyst from a commercial FCCU was charged to the test reactor. Fresh Davison CBZ-1 ® was used as the make-up catalyst. Physical properties of the fresh catalyst and the equilibrium catalyst are shown in Table IX below.

TABLE IX

| | Catalyst | |
|---|---|---|
| | Fresh Catalyst | Equilibrium Catalyst |
| Surface Area, $m^2/g$ | 322.0 | 98.0 |
| Pore Volume, cc/g | 0.50 | 0.36 |
| Densities, $lbs/ft^3$ | | |
| Aerated | 36.3 | 48.0 |
| Settled | 39.5 | 51.1 |
| Compacted | 47.3 | 58.3 |
| Particle Size Distribution, wt % | | |
| 0–20 microns | 0 | 0 |
| 20–40 microns | 11 | 18 |
| 40–80 microns | 41 | 67 |
| 80+ microns | 48 | 15 |
| Average Particle Size, microns | 69 | 55 |
| Activity, D + L | 71 | 56 |
| Alumina, wt % | 32.5 | 38.1 |
| Sodium, wt % | 0.45 | 0.68 |
| X-ray Metals, wppm | | |
| Cu | <10 | 110 |
| Ni | 50 | 450 |
| Fe | 260 | 6500 |
| Cr | 320 | 430 |
| V | 180 | 300 |

The operating conditions and averaged results of 23 catalytic cracking runs are shown in Table X below.

TABLE X

| Temperature vs Product Yields and Quality | | | | |
|---|---|---|---|---|
| Example | 2 | 3 | 4 | 5 |
| Riser Outlet Temp., °C. | 540 | 565 | 595 | 650 |
| Yields, wt % Fresh Feed | | | | |
| Hydrogen | 0.25 | 0.25 | 0.26 | 0.27 |
| Methane | 1.83 | 3.90 | 4.27 | 7.30 |
| Ethane | 1.83 | 3.20 | 4.27 | 7.30 |
| Ethylene | 1.60 | 2.85 | 4.00 | 7.10 |
| Propane | 1.88 | 2.25 | 2.46 | 2.10 |
| Propylene | 6.20 | 7.30 | 8.30 | 9.60 |
| Isobutane | 3.15 | 2.40 | 1.80 | 0.50 |
| Normal Butane | 1.12 | 0.90 | 0.62 | 0.13 |
| Butylene | 7.30 | 8.10 | 8.35 | 5.90 |
| DB Naphtha | 45.00 | 39.5 | 33.50 | 21.00 |
| LCGO (1) | 16.50 | 16.1 | 15.75 | 14.90 |
| HCGO (2) | 5.60 | 6.2 | 7.00 | 8.40 |
| Coke | 6.15 | 6.40 | 6.75 | 9.40 |
| 221° C. Conversion, wt % | 77.90 | 77.70 | 77.25 | 76.70 |
| DB Naphtha Quality Octanes | | | | |
| Research, Clear | 94.3 | 96.0 | 98.5 | 104.5 |
| Research, +3cc TEL | 99.3 | 100.8 | 102.2 | 106.0 |
| Motor, Clear | 82.2 | 84.0 | 86.3 | 93.1 |
| Motor, +3cc TEL | 86.9 | 88.0 | 89.9 | 95.3 |
| Yields, wt % Fresh Feed | | | | |
| Benzene | 0.60 | 0.90 | 1.27 | 2.20 |
| Toluene | 2.87 | 3.6 | 3.90 | 3.05 |
| Xylene | 3.45 | 3.8 | 3.90 | 2.90 |
| Aromatics Content, Vol % | | | | |
| LCGO (1) | 75 | 86 | 95 | 100 |

TABLE X-continued

| Temperature vs Product Yields and Quality | | | | |
|---|---|---|---|---|
| Example | 2 | 3 | 4 | 5 |
| HCGO (2) | 84 | 92 | 96 | 98 |
| Sulfur Content, wt % | | | | |
| HCGO | 3.5 | 3.5 | 3.6 | 3.7 |
| Metals Content, wppm (3) | | | | |
| HCGO | <1 | <1 | <1 | <1 |

(1) Light Cycle Gas Oil (220–355° C.)
(2) Heavy Cycle Gas Oil (355+° C.)
(3) Ni + V It will be evident from Examples 2–5 that the higher riser reactor outlet temperatures favor the production, both in yield and in quality, of heavy cycle gas oil particularly desirable as charge stocks for the manufacture of needle coke.

We claim:

1. In a fluid catalytic cracking process wherein a hydrocarbon stock containing sulfur is subjected to catalytic cracking in a fluid catalytic cracking zone, and hydrocarbon products effluent from said cracking zone are separated into fractions including a heavy cycle gas oil fraction having a boiling range above about 340° C., the method of producing an aromatic feedstock for the production of needle coke by delayed coking which comprises:

(a) subjecting said heavy cycle gas oil to hydrotreating in a hydrotreating zone, (b) passing a fraction of effluent from said hydrotreating zone boiling above 340° C. to catalytic cracking in a second fluid catalytic cracking reaction zone effecting conversion of said hydrotreated heavy cycle gas oil to light olefins and normally liquid aromatic hydrocarbons, (c) separating a light olefins fraction from the effluent from said second fluid catalytic cracking reaction zone, (d) recovering normally liquid aromatic hydrocarbons boiling below about 340° C. from the effluent from said second catalytic cracking zone, (e) and recovering an aromatic heavy gas oil fraction boiling above about 340° C. from the effluent of said second fluid catalytic cracking zone suitable as feedstock for the production of needle coke by delayed coking.

2. A method according to claim 1 wherein the catalysts in said fluid catalytic cracking zones are zeolite-type cracking catalysts.

3. A method according to claim 1 wherein said fluid catalytic cracking zones are riser-type reaction zones.

4. A method according to claim 1 wherein the cracking reaction temperature in said second fluid catalytic cracking zone is in the range of 540° to 650° C.

5. A method according to claim 3 wherein the riser reactor outlet temperature in said first fluid catalytic cracking zone is within the range of 510° to 540° C. and the riser reactor outlet temperature in the second fluid catalytic cracking zone is within the range of 565° to 620° C.

* * * * *